United States Patent [19]

Brown

[11] Patent Number: 4,953,250

[45] Date of Patent: Sep. 4, 1990

[54] DISPOSABLE WASH MITT WITH DETERGENT

[76] Inventor: Steven R. Brown, 2003 Granger Rd., Manitowoc, Wis. 54220

[21] Appl. No.: 389,536

[22] Filed: Aug. 3, 1989

[51] Int. Cl.[5] ..... B08B 1/00; B32B 3/02

[52] U.S. Cl. ..... 15/104.94; 15/227; 401/7; 428/96; 428/173

[58] Field of Search ..... 15/104.93, 104.94, 227; 428/96, 173; 401/7; 28/109

[56] References Cited

U.S. PATENT DOCUMENTS

| | | | |
|---|---|---|---|
| 1,209,763 | 12/1916 | Rosengren | 401/7 |
| 1,990,030 | 2/1935 | Jaffe | 15/104.94 X |
| 2,528,183 | 10/1950 | Schmidt | 428/96 X |
| 3,581,447 | 6/1971 | Falivene | 15/104.93 X |
| 3,664,909 | 5/1972 | Ackley | 28/112 X |
| 3,681,183 | 8/1972 | Kalwaites | 28/109 X |
| 3,711,889 | 1/1973 | Jennings | 15/227 |
| 4,347,931 | 9/1982 | Ginger et al. | 15/227 X |
| 4,359,798 | 11/1982 | Lovan | 15/104.94 |
| 4,390,582 | 6/1983 | Pickens, Jr. et al. | 28/109 X |

FOREIGN PATENT DOCUMENTS

| | | | |
|---|---|---|---|
| 279463 | 7/1967 | Australia | 15/104.94 |
| 68516 | 1/1983 | European Pat. Off. | 15/104.94 |
| 118850 | 9/1980 | Japan | 428/173 |
| 226984 | 8/1943 | Switzerland | 15/227 |
| 491053 | 8/1938 | United Kingdom | 15/104.94 |
| 88/00015 | 1/1988 | World Int. Prop. O. | 401/7 |

*Primary Examiner*—Henry J. Recla
*Assistant Examiner*—Robert M. Fetsuga
*Attorney, Agent, or Firm*—Francis J. Bouda

[57] ABSTRACT

A disposable washing glove is shown which includes a felted base made of carded staple fibers mechanically interlocked, structured by use of special forked needles to create a high-pile fabric, having recesses therein. The fabric is coated on one side with a detergent material which also fills the recesses to permit a timed release of the detergent during use.

8 Claims, 1 Drawing Sheet

DISPOSABLE WASH MITT WITH DETERGENT

BACKGROUND OF THE INVENTION

Wash cloths and scrubbing devices have long been known, and in the United States have become so commonplace as to be sold in combination with towels and bath mats.

In the United States, the wash cloth is generally a high-pile cotton fabric material, whereas in Europe it is quite often a woven fabric, fairly thin and smooth.

The manufacture of wash or scrubbing mitts or gloves is also well-known, and quite often these are made of the same high-pile cotton fabric as the flat wash cloth.

In the last decade or two, the use of disposable fabrics for cleaning, polishing, scrubbing, etc., has been developed, and it is also well-known to provide a needle-punched, high-pile, nonwoven fabric material for carpets, wall coverings, geotextiles and the like.

With many of these washing fabrics, a soap or detergent is often separately applied or provided.

To distinguish from all of these devices of the prior art, my invention comprises a disposable, nonwoven, high-pile wash mitt including a detergent material and means which provide a timed release of the detergent. The basic material is a nonwoven felt, which is made of staple fibers carded and mechanically interlocked. The felt is then structured by use of special forked needles to create a high-pile fabric, which is subsequently back-coated with a detergent and dried to remove all of the water so as to create a finished product which is dry-to-touch. The fabric is then subsequently cut and sewn into a mitt-like product; and by merely adding water, the detergent is released from the encapsulation of the structuring process and the cleansing process begins.

One of the primary objects is to provide a disposable wash-mitt for the cleaning of autos, boats, trucks, campers, and other similar items.

A further object is to provide a disposable mitt which is effective with detergent, until the detergent is removed therefrom, but which also serves as a scrubbing device without detergent.

An additional object is to provide a needle-punch fabric which has recesses formed therein for the timed-release of the detergent.

SUMMARY OF THE INVENTION

The needle-punched fabric of the present invention may consist of any synthetic fiber or blend thereof. A preferred fiber is polyester because of its economic advantages, with a denier range of between 6–15 and with a staple length of between 60 to 90 millimeters.

The fabric is first formed by carding (or similar process) the fibers into a web and thereafter mechanically interlocking the fibers by the use of barbed felting needles. The web is then passed through a needle loom where forked needles produce the high-pile surface, and in the process of forming the pile on the face-side of the fabric, the forked needles leave holes in the back-side of the fabric. These holes, or pores, provide natural reservoirs for the later application of detergent and permits the important timed-release of the detergent.

In addition to encapsulating the detergent, the high pile creates an excellent, non-abrasive cleansing surface, similar to the more traditional high-pile cleaning mitts made from natural sheepskin or sliver knit.

Because of the relatively low cost of the polyester fiber and the nonwoven and needling processes, the fabric and a mitt formed therefrom can be produced at a fraction of the cost of prior devices and, therefore, the product is readily disposable.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
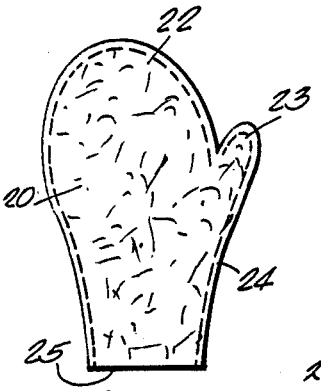
FIG. 1 is a plan view of a mitt formed according to the present invention.

FIG. 5 is a composite process-diagram showing the step-wise production of the fabric of the present invention. p Referring now to FIG. 1, there is shown a mitt 20 generally shaped in the form of a hand, and including a finger-portion 22 and a thumb-portion 23. The two pieces of fabric from which the mitt is formed are either sewed or heat-sealed around the edge 24, leaving an opening 25 into which the hand can be inserted.

Figure 2:
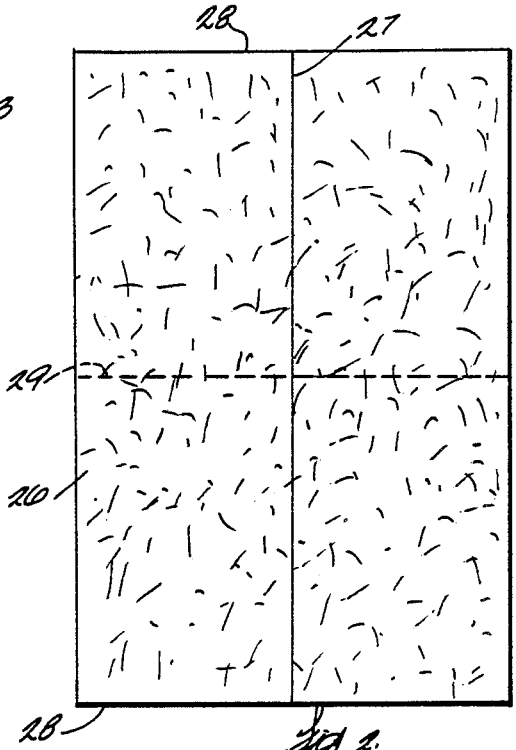
FIG. 2 is a plan view of a nonwoven fabric made according to the present invention but prior to forming a mitt therefrom.

The material from which the mitt is formed, shown in FIG. 1 (or the simplified mitt shown in FIG. 3) is shown in FIG. 2. A carded and needle-punched and impregnated web 26 can be cut along the longitudinal lines 27 and the end lines 28 and, thereafter, folded along a crease-line 29 to form a rectangular pouch or pocket, or mitt, shown in FIG. 3. This mitt 21 formed from the fabric 26 folded along the line 29, leaving the opposite end open, is sewed or heat-sealed or similarly seamed along the side edges 30 and 31.

In a preferred form and size, the mitt 21 has its major dimension approximately nine inches in length, and its minor dimension approximately six inches in length.

Figure 3:
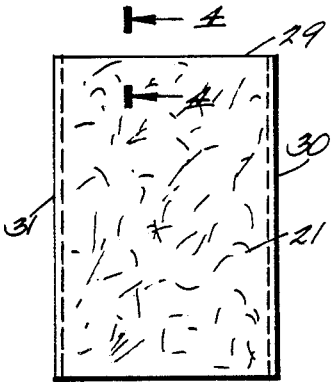
FIG. 3 is a simplified form of mitt.
Figure 4:
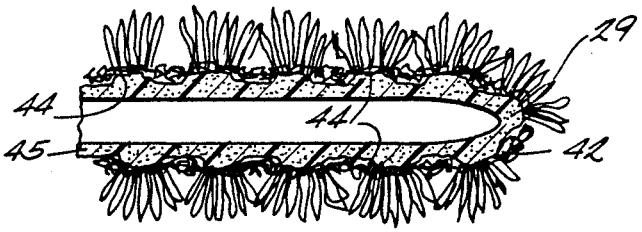
FIG. 4 is a cross-section taken generally along line 4—4 of FIG. 3.
Figure 5A:
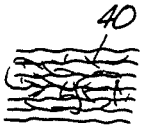
Figure 5B:
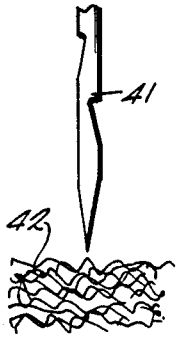
Figure 5C:
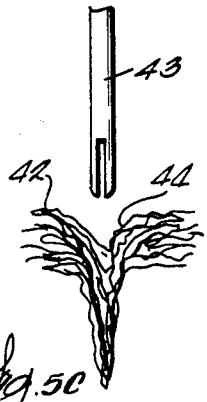
Figure 5D:
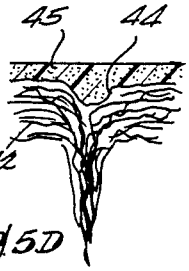

In FIG. 4, I have shown, by illustrating a crosssection taken along line 4—4 of FIG. 3, how the fold line 29 enables the material to be provided in two opposed webs with the back or inner-side in juxtaposition, and with the face, or outer-side, externally available to do the scrubbing.

In FIG. 5, I have shown a step-wise process diagram wherein the fibers 40 are laid down by carding, garnett or similar nonwoven fabric production. This is shown at position "A" in FIG. 5. In position "B" I show how a barbed needle 41 can be passed through the carded fibers 40 to form the entangled fibers 42.

In the next step, a forked needle 43 is forced into the entangled batt 42, and in doing so, not only provides the high-pile fiber on the face surface but, additionally, on the back or inner surface provides the recesses or pores 44. This is illustrated at position "C" in FIG. 5.

In position "D" in FIG. 5, I have illustrated how the fabric can then be coated with a detergent/ which not only fills the pores 44 but provides a coating on the back-side. This detergent can be laid down in a liquified form and ultimately dried, so that when a fabric is formed into a glove or a mitt or other washing product, the material is dry-to-touch.

Subsequently, when the mitt is actually used in a scrubbing action in the presence of water, the water dissolves the detergent, which is then released in a timed-released fashion out of the pores and inside the mitt through to the high-pile or rubbing surface side of the mitt.

The detergent can be applied in any number of ways, including a spray-coating, roll-coating, or knife-coating.

Because the water of the detergent-solution is subsequently removed in a drying process, it leaves the fabric dry-to-touch and can be easily cut, sewn and packaged.

In a preferred embodiment of the present invention, the fabric is cut into pieces approximately 6"×18", and then folded over at mid-line with the high-pile fabric on the outer side of both folds. The two longer (9") edges are then sewn or heat-bonded together to provide the simplified mitt shown in FIG. 3. Thus the optimum finished mitt is open on one end and has a finished size of approximately 6"×9".

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. A disposable, nonwoven, high-pile wash-mitt with timed release of the detergent, including a first-body portion and a second-body portion secured together to form the mitt, at least one of said body-portions including a nonwoven web having a high-pile exterior surface and a plurality of pores formed in an interior surface of said mitt wherein individual pores of said plurality of pores are disposed opposite corresponding individual portions of said high pile surface, said pores being filled and said interior surface being coated with a water-soluble detergent.

2. The wash mitt of claim 1 formed generally in the shape of a mitten with a finger pocket and a thumb pocket.

3. The wash mitt of claim 1 shaped as a rectangular pouch, three sides of which are secured and one side of which is opened to enable the insertion of a human hand therein.

4. The mitt of claim 3 wherein the edge opposite the open edge is a fold line.

5. The process of making a disposable nonwoven, high-pile wash mitt with timed release of the detergent which includes:

providing a plurality of polyester fibers, carding said fibers to form a nonwoven web of fabric,. needle-punching said carded web with a plurality of barbed felting needles, subsequently needle-punching said barbed-entangled web with a plurality of forked needles to provide a high pile on one side of the fabric and a plurality of recesses or pores on the other side thereof, subsequently coating the pore-including side of the fabric with a water-soluble detergent so as to fill the pores and to coat the surface of the fabric adjacent the pores, drying the detergent, and forming a wash mitt therefrom.

6. The process of making a disposable nonwoven high-pile wash mitt of claim 5 wherein the fibers forming the nonwoven fabric are polyester.

7. The process of making a disposable nonwoven high-pile wash mitt of claim 5 wherein the polyester fibers have a denier of between 6 and 15 and a staple length of between 60 to 9 millimeters.

8. The process of making a disposable nonwoven high-pile wash mitt of claim 5 wherein the detergent is applied by coating which may be either spray-coating, roll-coating or knife-coating.

* * * * *